US005724789A

United States Patent [19]

Corella

[11] Patent Number: 5,724,789

[45] Date of Patent: Mar. 10, 1998

[54] MULTI-COMPARTMENT PACKAGE, SYSTEM AND METHOD

[76] Inventor: Arthur P. Corella, 8166 Vanscoy Ave., North Hollywood, Calif. 91602

[21] Appl. No.: 699,036

[22] Filed: Aug. 19, 1996

Related U.S. Application Data

[63] Continuation-in-part of Ser. No. 651,110, May 27, 1996, which is a continuation-in-part of Ser. No. 317,186, Oct. 3, 1994, Pat. No. 5,531,358, which is a continuation-in-part of Ser. No. 014,753, Nov. 1, 1993, Pat. No. Des. 354,221.

[51] Int. Cl.[6] ..... B65B 9/02

[52] U.S. Cl. ..... 53/450; 53/546; 53/553; 53/550

[58] Field of Search ..... 53/450, 451, 546, 53/553, 554, 555

[56] References Cited

U.S. PATENT DOCUMENTS

| | | | |
|---|---|---|---|
| 2,162,230 | 6/1939 | Salfisberg | 53/554 X |
| 2,401,110 | 5/1946 | Rohdin | 53/546 X |
| 3,245,197 | 4/1966 | Van Mil et al. | 53/555 X |
| 3,358,419 | 12/1967 | Bjork et al. | 53/546 |
| 3,383,269 | 5/1968 | Kopp | 53/546 X |
| 3,391,047 | 7/1968 | Kopp | 53/554 X |

FOREIGN PATENT DOCUMENTS

| | | | |
|---|---|---|---|
| 279006 | 11/1989 | Japan | 53/553 |

*Primary Examiner*—Linda Johnson
*Attorney, Agent, or Firm*—Donald Diamond

[57] ABSTRACT

A peripherally sealed, juxtaposed, multi-compartment, flexible package is provided which includes a pair of outer walls and at least one separator wall disposed between the outer walls for dividing the package into a plurality of compartments. All of the walls are sealed at a common peripheral terminus, and flowable material is disposed within each of the compartments. The package is adapted to be torn open to simultaneously dispense and admix the flowable material. The multi-compartment dispensing package is manufactured by feeding at least three sheetings of heat sealable flexible film through a first embodiment of form-and-fill packaging instrumentation. A two-compartment dispensing package is manufactured by feeding two sheetings of film through a second instrumentation embodiment including an assembly dividing one sheet into two halves which become outer walls.

7 Claims, 5 Drawing Sheets

MULTI-COMPARTMENT PACKAGE, SYSTEM AND METHOD

CROSS-REFERENCES TO RELATED APPLICATIONS

The present application is a continuation-in-part of my application Ser. No. 08/651,110 filed May 21, 1996, entitled "Metered Flexible Dispensing Package", currently pending; which is a continuation-in-part of my application Ser. No. 08/317,186 filed Oct. 3, 1994, entitled "Flexible Dispensing Package", issued as U.S. Pat. No. 5,531,358; which is a continuation-in-part of my design application Ser. No. 29/014,753 filed Nov. 1, 1993, entitled "Dispensing Package With Teardrop Finger Slot", issued as U.S. Pat. No. Des. 354,221.

BACKGROUND OF THE INVENTION

1. Field Of The Invention

The present invention relates to dispensing packages. More particularly, the invention relates to a multi-compartmented flexible dispensing package wherein the contents of each compartment are adapted to be admixed at the time of use. The admixture is formed when the compartments are simultaneously and proximately opened, and the contents of each dispensed by applying pressure to the package sides.

2. Description Of The Related Art

The packaging of liquids, gels and pastes in heat sealable dispensing enclosures by high-speed production techniques and equipment is a well-developed art. Heat sealed, packaged products are generally referred to as having a "form-filled" sealed construction, and are sometimes characterized as "form-and-fill" packages. Such packages can be fabricated in a wide variety of shapes and configurations. For example, three basic pouch configuration types are known as pillow type, three-sided seal type, and four-sided seal type. Pillow type packages are constructed from a single sheet, and are provided with a top and a bottom seal along a vertical seam which can take the form of a fin seal or a lap seal. Three-sided seal type packages are usually formed from a single sheet and include a a top seal, two opposed side seals, and a bottom fold. Four-sided seal type packages are constructed from one or two sheets and include a top seal, a bottom seal, and two opposed side seals. Single-layer sheets or multi-layer laminate sheets can be used in fabricating heat sealable packages. In either form, oppositely disposed sealable faces generally are comprised of heat sealable thermoplastic materials such as polyethylene or polypropylene. Where laminates are used, the inner layer may be polyethylene, while the outer layer may be cellophane, paper, polyester, metallized polyester, aluminum foil or the like. Heat sealable laminates comprising three or more layers are sometimes referred to as having a "sandwich" structure or configuration.

My prior patent, U.S. Pat. No. 4,696,404, is directed to the problem of opening tear-resistant packages, particularly when the fingers are wet or oily. The invention provides for a peripherally sealed dispensing package and an inner seal disposed within a central portion of the package. The inner seal includes an aperture extending therethrough which may be used to tear the package open for removal of its contents. The aperture assists in opening the package so that contents from the main body of the package may be dispensed through two contiguous openings created along a sealed edge of the package.

My prior patent, U.S. Pat. No. 5,531,358, provides a flexible package including an enclosure for storing a material, typically a viscous liquid. The package includes a generally vertical depending seal which divides the enclosure bilaterally into a storage reservoir and a dispensing channel. The channel includes an open upper end and a closed lower end, wherein the upper end is in fluid communication with the reservoir. The lower end is proximate to an aperture within the depending seal adapted to be torn open, thereby collaterally tearing open the lower end of the channel and a contiguous portion of the peripheral seal, enabling removal of package contents.

My pending application Ser. No. 08/651,110 provides a flexible package for repetitively dispensing a liquid material, such as a medicament, in minute and not necessarily equal quantities. The package includes superposed opaque and transparent sides and a circumferential seal determining a sealed enclosure. Two contiguous depending seals separated by a slot divide the enclosure into a storage reservoir and a dispensing channel in fluid communication. When the channel lower end is torn open, use of a ruled scale imprinted on the opaque side combined with viewing through the transparent side enable the selected dispensing of a measured quantity of material disposed within the channel.

A problem heretofore not addressed satisfactorily in the packaging arts is the packaging of precursor admixture ingredients, typically gels and/or pastes, particularly those which due to mutual chemical reactivity should not be combined until shortly before the admixture is to be used. Examples are an epoxy and its hardener, an acrylic polymer and its cross-linking agent, and medicinal compounds which must be administered in combination without premature premixing which would reduce their effectiveness. For convenience and accessibility, it is desirable to enclose such ingredients in individual compartments of a single package. It is also desirable that the package be constructed with its compartments juxtaposed rather than arrayed side-by-side in a linear array, so that the compartments can be opened simultaneously and their ingredients dispensed simultaneously through juxtaposed orifices to immediately form the admixture.

Multi-compartment packages with juxtaposed compartments and orifices are presently known, but are manufactured as separate sealed packets which then are glued or otherwise joined together. An example is "MENTADENT"™, a dentifrice manufactured by Cheseborough Ponds U.S.A. Co. of Greenwich, Conn. which is distributed in two packets glued together, one containing a sodium fluoride toothpaste and the other containing baking soda and peroxide. This packaging method requires not only that each type of packet be manufactured and filled separately so that more than one machine must be used, but that the several single-compartment packets making up a package be juxtaposed and attached together in subsequent operations. The method is therefore inherently inefficient and expensive.

OBJECTS OF THE INVENTION

Accordingly, it is an object of the present invention to provide a multi-compartment package for simple, convenient and inexpensive packaging of juxtaposed materials which are to be dispensed simultaneously as an admixture.

Another object of the invention is to provide a process for manufacturing a package having juxtaposed multiple compartments whereby a fillable pre-package is formed, ingredients are inserted into the several compartments, and the compartments are sealed, using a single instrumentation.

A further object of the invention is to provide a multi-compartment package that is simple and inexpensive to manufacture.

A still further object of the invention is to provide a multi-compartment package that is simple, reliable and easy to use.

Other objects of the invention will become evident when the following description is considered with the accompanying drawing figures. In the figures and description, numerals indicate the various features of the invention, like numerals referring to like features throughout both the drawings and the description.

SUMMARY OF THE INVENTION

These and other objects are achieved by the present invention which provides, in a first aspect, an instrumentation for manufacturing from film sheeting a multiplicity of peripherally sealed dispensing packages each having at least two sealed juxtaposed compartments, with each compartment containing a gel, paste or liquid material to be dispensed. In a first embodiment, the instrumentation includes at least three continuous supplies of flexible film sheeting, each supply extending in a generally planar portion, with the portions being aligned so as to be substantially mutually parallel, thereby determining opposed outer portions and at least one inner portion, with pairs of adjacent portions separated by a small distance. The instrumentation further includes a sealing mechanism including opposed platens each having a contact portion, the platens being moveable orthogonal to the parallel sheeting portions so that each contact portion simultaneously contacts and exerts pressure on an outer sheeting portion. Each contact portion includes a planar heated surface orthogonal to a plurality of parallel planar surfaces, with each consecutive pair of parallel surfaces bounding a compartment-shaped cavity. Bringing the heated contact portions into pressing contact with the outer sheeting portions simultaneously forms a front lateral seal, opposed side seals, and juxtaposed open compartments of a plurality of packages, the packages formed being attached at contiguous side seals with the number of packages being one less than the number of parallel surfaces on the platen contact portions. The outer sheeting portions thus form the sides of each package. The instrumentation further includes a tubing section inserted between each pair of adjacent sheeting portions for injecting materials into the open compartments. The heated contact portions also simultaneously form a rear lateral seal of the previously filled packages forward of and contiguous to the packages being formed, thus sealing the materials within the compartments of each package. The instrumentation further includes a holding mechanism including opposed platens each having a planar surface transverse to the parallel sheeting portions. The platens are moveable orthogonal to the sheeting portions so that when the sealing mechanism platens are open the holding mechanism platens are closed and in pressing contact with the outer sheeting portions, thus maintaining sheeting portion planarity and alignment. When the sealing mechanism platens are closed the holding mechanism platens are open, thus permitting the sheeting portions to move forward as the sealing mechanism moves laterally forward.

A second embodiment includes the sealing mechanism, two tubing sections, and holding mechanism of the first embodiment. However, the instrumentation has only two continuous supplies of flexible film sheeting which are mutually orthogonal. One sheeting passes beneath a sheeting divider assembly including a metallic plate having a slitting mechanism which divides the sheeting into two opposed halves which are each fed around two rollers to become opposed outer walls similar to those of the first embodiment. The other sheeting is fed between the tubing sections to become a separator wall.

In another aspect the invention provides a method for producing a peripherally sealed package having at least two sealed juxtaposed compartments, with each compartment containing a dispensable material. The method includes: superimposing at least three heat sealable flexible sheets of like configuration; sealing the periphery of the sheets so as to determine a pre-package having at least two fillable compartments each having a mutually conjoint external opening; adding flowable material to each compartment through the openings; and sealing the openings.

In still another aspect the invention provides a process for manufacturing a peripherally sealed package having at least two sealed juxtaposed compartments, each compartment containing a gel, paste or liquid material. The process includes the steps of: feeding at least three continuous flexible film sheetings, each extending in a generally planar portion, so that the portions are aligned and mutually parallel thereby determining opposed outer portions and at least one inner portion, with each pair of adjacent portions separated by a small distance; forming simultaneously a front lateral seal and opposed side seals peripherally determining and common to at least two rearwardly open juxtaposed compartments; injecting a material between each pair of adjacent portions; and forming a rear lateral seal, opposed to the front lateral seal and common to the compartments.

In yet another aspect the invention provides a dispensing package including at least two juxtaposed sealed compartments each enclosing a gel, paste or liquid material. Each compartment is determined by a superposed pair of flexible film sheeting sections bounded peripherally by opposed lateral seals and opposed side seals common to the sheeting sections, with each pair of contiguous compartments separated by a common sheeting section. A first preferred embodiment includes two outer sheeting sections and an inner sheeting section disposed between the outer sections. The three sections are bounded peripherally by opposed lateral seals and opposed side seals common to the sections. The outer sections thus form the package sides. The sheeting sections and seals determine two juxtaposed sealed compartments separated by the inner section, each compartment including a container portion and an orifice portion. The orifice portions are generally congruent and adapted to be opened simultaneously, so that the contents of each compartment can be dispensed simultaneously to form an admixture. A second preferred embodiment includes two outer sheeting sections and two inner sheeting sections disposed between the outer sections. The four sections are bounded peripherally by opposed lateral seals and opposed side seals common to the sections. The outer sections thus form the package sides. The sheeting sections and seals determine three juxtaposed sealed compartments. As in the first embodiment, each compartment includes a container portion and an orifice portion, with the orifice portions adapted to be opened simultaneously, allowing simultaneous dispensing of the material in each compartment.

Typically, a package is hand-held while a scissors is used to cut the package laterally at the orifice end thereby simultaneously opening the several compartments. Alternatively, if a package comprises a relatively low-strength material, the package may be torn open by using the fingers to apply a shearing force beginning at a notch in a side seal portion proximate to the orifice and continuing laterally along a guideline printed on one or both sides and transecting the orifice. By applying pressure to the flexible package sides, material is dispensed from each compartment simultaneously to form an admixture.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENTS

Figure 1:
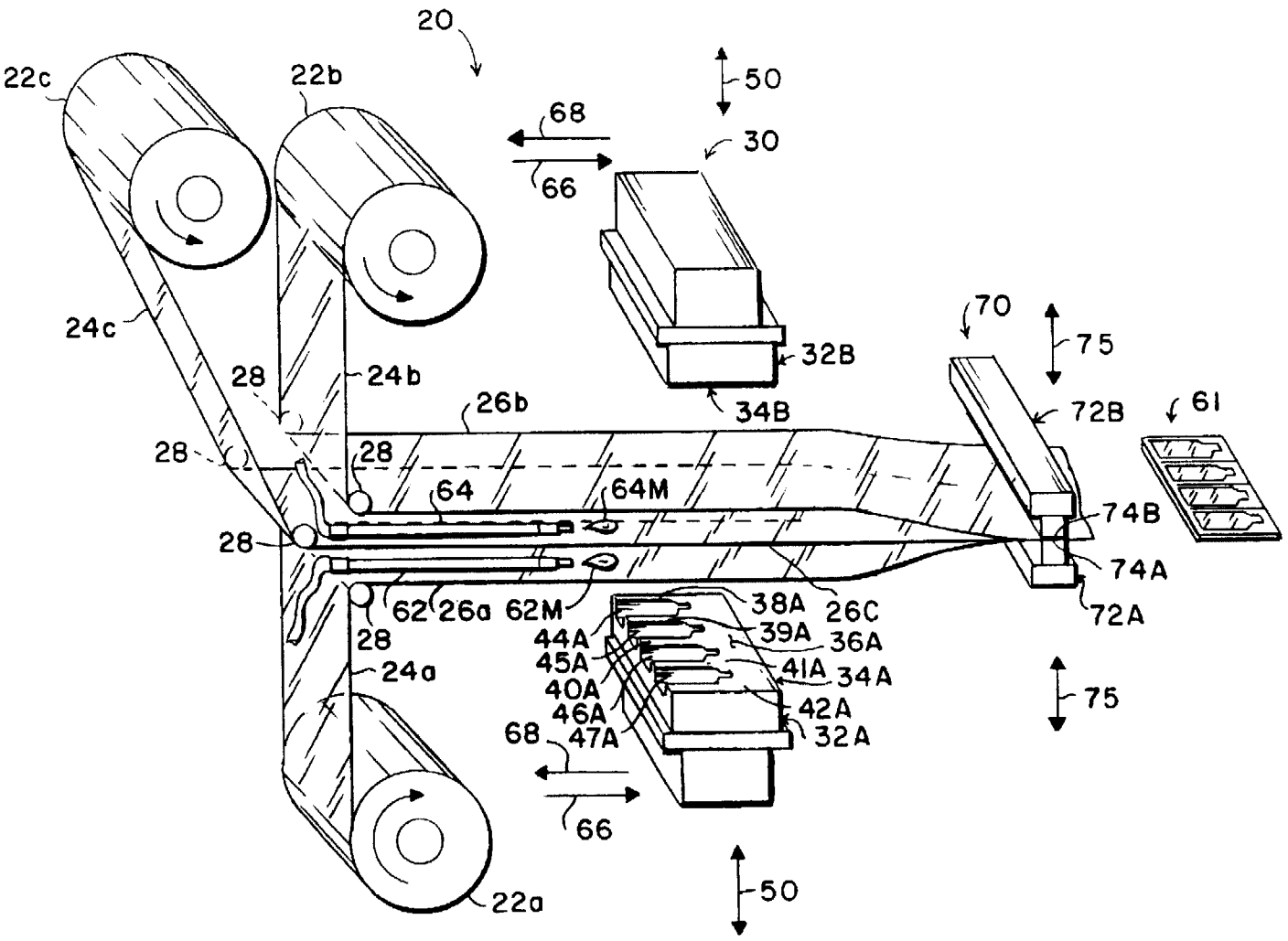
FIG. 1 is a schematic perspective view of a first embodiment of an instrumentation for manufacturing a flexible two-compartment dispensing package according to the invention.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

The invention relates to an article of manufacture which is primarily intended for storing and dispensing gel, paste and/or liquid materials which are components of an admixture and which need to be kept separate until the admixture is formed. However, the invention is not limited to particular types of material to be stored and dispensed, and can be used for storing and dispensing any material that can be placed within a subject package, although gels, pastes and/or liquids are preferred.

Figure 2:
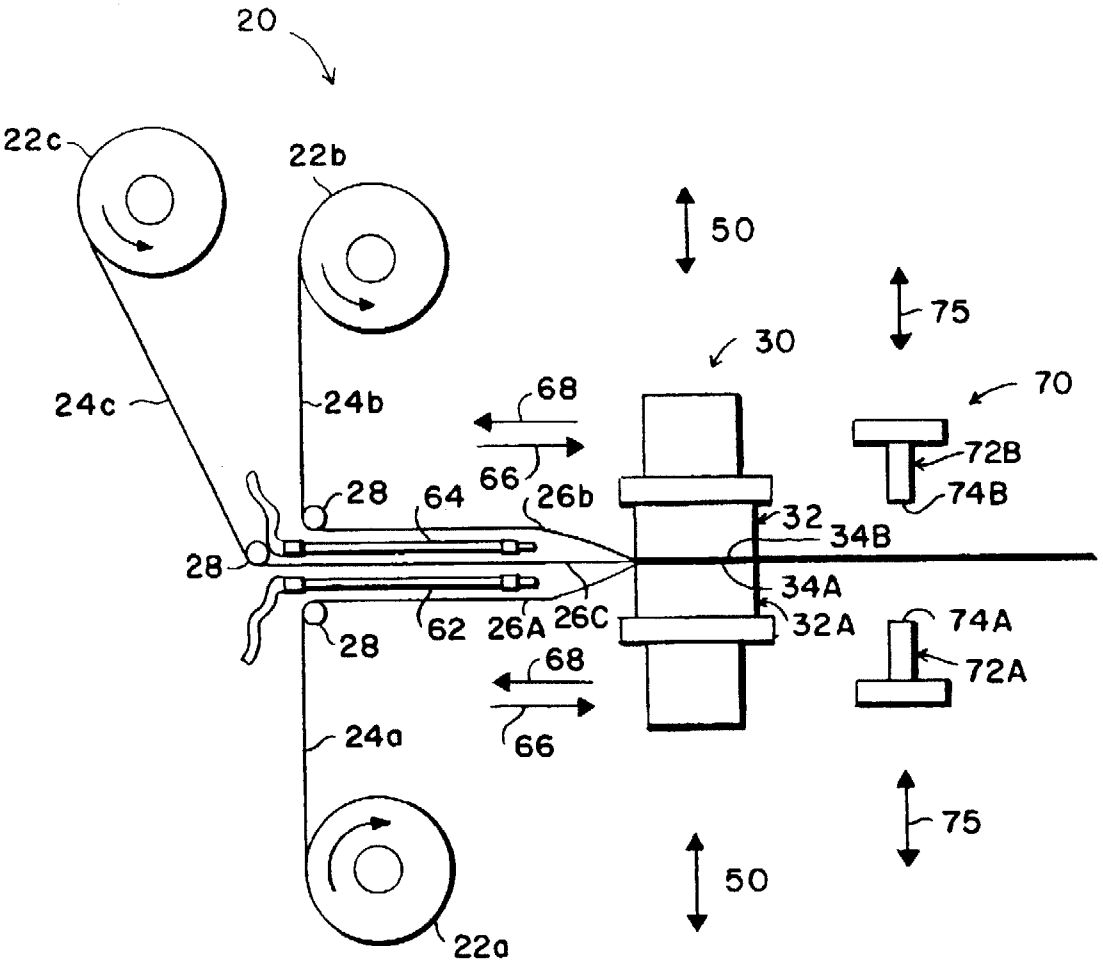
FIG. 2 is a schematic side elevational view of the instrumentation.

Referring to FIGS. 1 and 2, a first preferred embodiment of a packaging instrumentation 20 includes three rotatable rolls or sources 22*a*, 22*b*, 22*c* of flexible film sheeting 24*a*, 24*b*, 24*c*, each of which may comprise a high-strength single layer such as high-density polyethylene. Alternatively, sheetings 24*a* and 24*b* may be laminates having a heat sealable inner layer such as "SERAN"™, "SURYLAN"™ or "BAREX"™, and an outer layer such as polypropylene, cellophane, polyester, metallized polyester, or aluminum foil. In order to effect heat sealing, the same material used for the inner layers of sheetings 24*a* and 24*b* must be used for sheeting 24*c*. Sheetings 24*a*, 24*b* and 24*c* extend in generally planar portions 26*a*, 26*b*, 26*c*, respectively, guided over rollers 28 which align the portions to be mutually parallel, adjacent portions being separated by a small distance. The rollers 28 enable the sheeting portions to be fed within a sealing mechanism 30 including opposed platens 32A, 32B each having a contact portion 34A, 34B, respectively. Contact portion 34A includes a generally planar surface 36A orthogonal to five parallel, generally planar surfaces 38A, 39A, 40A, 41A, 42A, the surface pairs (38A, 39A), (39A, 40A), (40A, 41A), (41A, 42A) bounding, respectively, compartment-shaped cavities 44A, 45A, 46A, 47A. Although not shown in FIGS. 1 and 2, contact portion 34B includes a generally planar surface 36B orthogonal to five parallel, generally planar surfaces 38B, 39B, 40B, 41B, 42B, the surface pairs (38B, 39B), (39B, 40B), (40B, 41B), (41B, 42B) bounding, respectively, compartment-shaped cavities 44B, 45B, 46B, 47B. Each of these features is directly opposite the corresponding feature of contact portion 34A designated by the same numeral.

Figure 3:
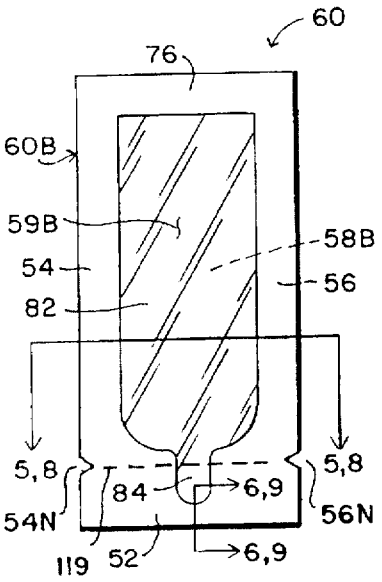
FIG. 3 is a plan view of a first (two-compartment) or second (three-compartment) embodiment of a flexible dispensing package according to the invention.
Figure 5:
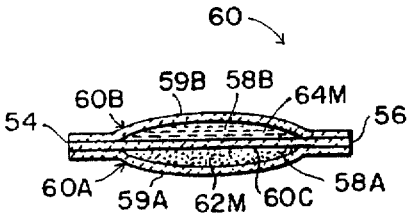
FIG. 5 is a cross-sectional view of the FIG. 4 package taken along the line 5—5 of FIG. 3.

As indicated by double-headed arrows 50, platens 32A and 32B are moveable toward and away from each other. When surfaces 36A and 38A–42A, and surfaces 36B and 38B–42B are heated and the platens moved toward each other into a "closed" position (see FIG. 2), contact portions 34A and 34B come into pressing contact with sheeting portions 26*a* and 26*b*, respectively, forming, as best shown in FIGS. 3 and 5, a first (front) lateral seal 52, opposed side seals 54, 56, and rearwardly open juxtaposed compartments 58A, 58B of two-compartment packages 60 attached at contiguous side seals to form a four-package strip 61 (in FIG. 1 a strip has been separated from the sheetings in a later process step). Pressing contact of cavities 44A–47A and 44B–47B with sheeting portions 26*a* and 26*b*, respectively, forms cavity-shaped embossed areas 59A (not shown in FIG. 3), 59B on package sides 60A (not shown in FIG. 3), 60B, respectively. Referring again to FIGS. 1 and 2, the two open compartments in each package are filled with a gel, paste or liquid material 62M, 64M, respectively, injected by first and second tubing sections 62, 64 inserted, respectively, into compartments 58A, 58B.

As will be apparent to those skilled in the packaging arts, sheeting portions 26*a*, 26*b*, 26*c* may be advanced by forward motion of sealing mechanism 30 when platens 32A and 32B are in the closed position, as indicated by single-headed arrows 66. When the platens are then opened, the instrumentation 20 is readied for the next cycle by moving sealing mechanism 30 backward to its sealing position, as indicated by single-headed arrows 68. Advancing the sheeting portions causes the packages 60 to be fed within a holding mechanism 70 including opposed open platens 72A, 72B each having a generally planar contact surface 74A, 74B, respectively. As indicated by double-headed arrows 75, platens 72A and 72B are moveable toward and away from each other so that the platens are closed as sealing mechanism 30 is retracted, thus maintaining planarity and alignment of sheeting portions 26*a*, 26*b*, 26*c*. Referring to FIG. 1, surfaces 36A, 36B are sufficiently wide so that when, as shown in FIG. 2, the platens 32A, 32B are closed, a second (rear) lateral seal 76 is formed on each package (see FIG. 3) of a strip (not shown) contiguous to and forward of the package strip being formed, into whose compartments the materials 62M, 64M have been injected. Holding mechanism 70 may include opposed cutters 80A, 80B (not shown), so that the forward-most package strip is separated from the sheetings when platens 72A, 72B are closed. Alternatively, the cutters may be mounted on a separate mechanism. A second cutting mechanism is required to separate package strips into individual packages.

Although FIGS. 1 and 2 show the instrumentation 20 horizontally disposed, the preferred orientation is for sheeting portions **26*a*, 26*b*, 26*c* and tubing sections 62, 64 to be generally vertical so that sealing platens 32A, 32B** move down and up when advancing the sheeting portions and beginning a new cycle, respectively, rather than forward and backward.

It will be apparent to those skilled in the packaging arts that the number of juxtaposed compartments is not limited to two, but may be increased to three by using an additional sheeting portion which is coplanar with portions **26*a*, 26*b*, 26*c*, increased to four by using two additional coplanar sheeting portions, etc. The additional sheeting portions must be the same material as portions 26*a*, 26*b*, 26*c* if the package comprises single-sheet material, or the same material as the inner laminate of portions 26*a*, 26*b* if the package comprises laminate-sheet material. It will also be apparent that by modifying contact portions 34A, 34B to include a smaller or larger number of cavities each bounded by a pair of planar surfaces, the number of packages simultaneously produced can be varied from a minimum of one to a maximum constrained by the lateral dimensions of instrumentation 20**.

Figure 4:
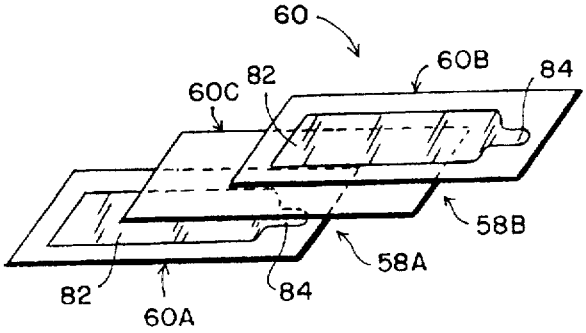
FIG. 4 is an exploded perspective view of the FIG. 3 two-compartment package.
Figure 6:
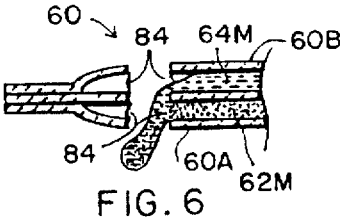
FIG. 6 is a cross-sectional view of the FIG. 4 package taken along the line 6—6 of FIG. 3.

FIGS. 3, 4 and 5 show a two-compartment package 60 which is a first preferred embodiment of a package manufactured according to the invention. As described, supra, the package 60 includes opposed sides 60A, 60B circumscribed by opposed front and rear lateral seals 52, 76 and opposed side seals 54, 56, and juxtaposed compartments 58A, 58B. As shown in FIGS. 4 and 5, compartments 58A and 58B are bounded, respectively, by side 60A and a wall 60C (formed from sheeting portion **26*c*), and by wall 60C and side 60B. Compartments 58A, 58B are filled, respectively, with materials 62M, 64M. As shown in FIGS. 3 and 4, compartments 58A and 58B are each divided into a container portion 82 extending in an orifice portion 84. As shown in FIG. 6, the two orifice portions are contiguous so that when the orifices are transected by laterally cutting or tearing open the package, materials 62M, 64M may be dispensed simultaneously by applying pressure to sides 60A, 60B. Alternatively, the orifice portions can extend across the package width or can be disposed at a corner of front seal 52**.

Figure 7:
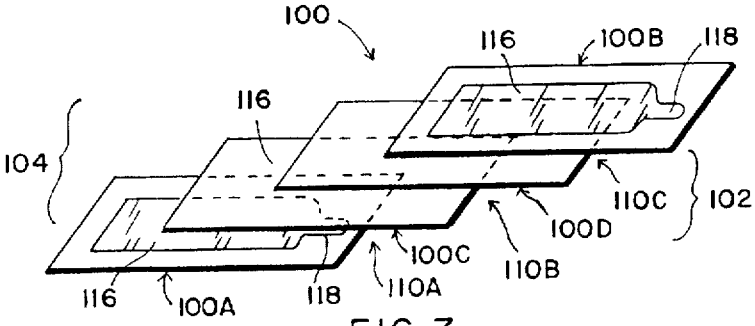
FIG. 7 is an exploded perspective view of the FIG. 3 three-compartment package.
Figure 8:
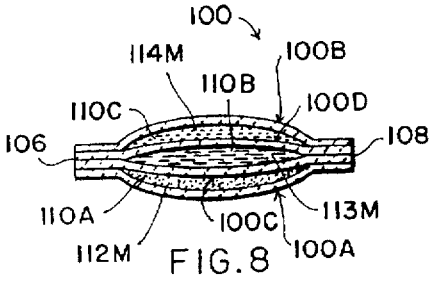
FIG. 8 is a cross-sectional view of the FIG. 7 package taken along the line 8—8 of FIG. 3.
Figure 9:
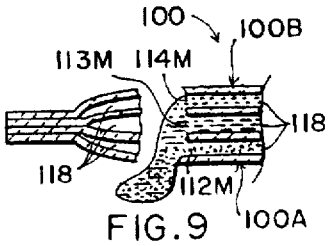
FIG. 9 is a cross-sectional view of the FIG. 7 package taken along the line 9—9 of FIG. 3.

FIGS. 7 and 8 show a three-compartment package 100 which is a second preferred embodiment of a package manufactured according to the invention. As indicated in FIG. 3, package 100 in plan view has the same appearance as package 60. Package 100 includes opposed sides 100A, 100B circumscribed by opposed front and rear lateral seals 104 and opposed side seals 106, 108, and juxtaposed compartments 110A, 110B, 110C. Compartments 110A, 110B, 110C are bounded, respectively, by side 100A and a wall 100C, wall 100C and a wall 100D, and by wall 100D and side 100B. Compartments 110A, 110B, 110C are filled, respectively, with materials 112M, 113M, 114M. Similar to compartments 58A, 58B of package 60, compartments 110A, 110B, 110C each are divided into a container portion 116 extending in an orifice portion 118. As shown in FIG. 9, the three orifice portions are contiguous so that when the orifices are transected by laterally cutting the package, materials 112M, 113M, 114M may be dispensed simultaneously by applying pressure to sides 100A, 100B. Alternatively, orifice portions 118 can extend across the package width or can be disposed at a corner of front seal 102.

Package 60 or 100 typically is hand-held while a scissors is used to cut across front seal 52, 102, respectively, and through orifice 84, 118, respectively, thereby simultaneously opening the several juxtaposed compartments. Referring to FIG. 3, if the package comprises a relatively low-strength material, a notch in each side seal proximate to the orifice whose apexes are connected by a guideline 119 printed on one or both sides and transecting the orifice, such as notch 54N in seal 54 and notch 56N in seal 56 adapted, respectively, to accommodate left-handed and right-handed persons, may be included so that the package can be easily torn open by hand.

Figure 11:
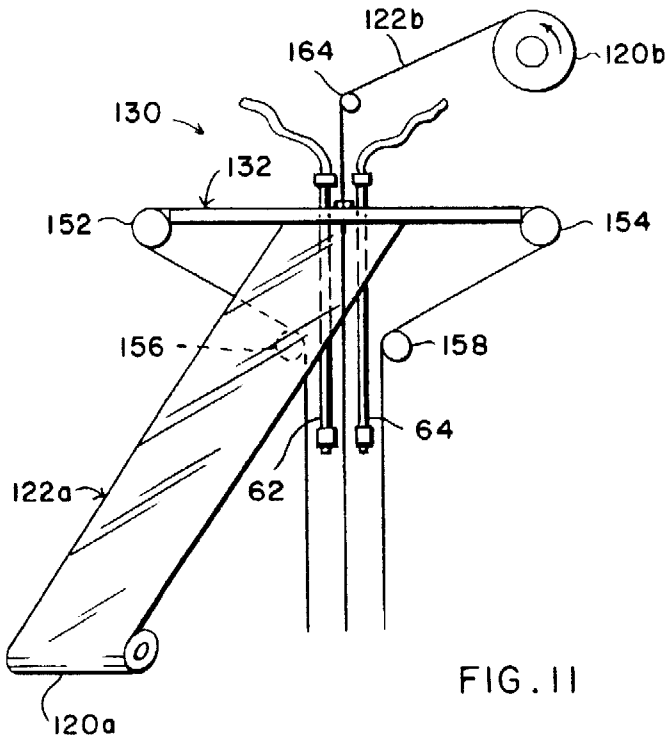
FIG. 11 is a plan view of the FIG. 10 supplies, divider assembly, and tubing sections.
Figure 10:
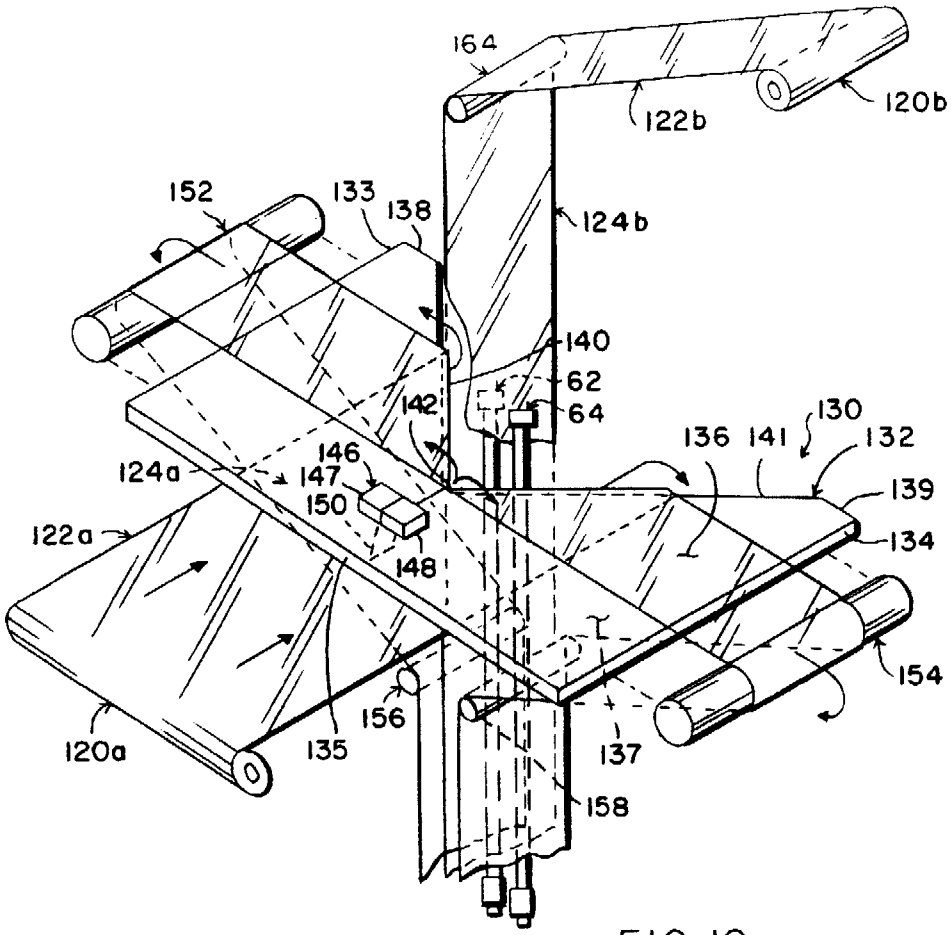
FIG. 10 is an exploded perspective view of two orthogonal film sheeting supplies, a sheeting divider assembly, and two tubing sections of a second embodiment of an instrumentation for manufacturing a flexible two-compartment dispensing package according to the invention.
Figure 12A:
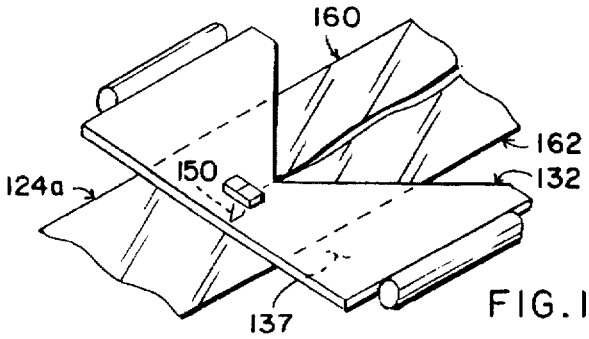
FIGS. 12A–12D show schematically successive steps in how a film sheeting is divided into two halves routed in opposite directions by the FIG. 10 divider assembly.
Figure 12B:
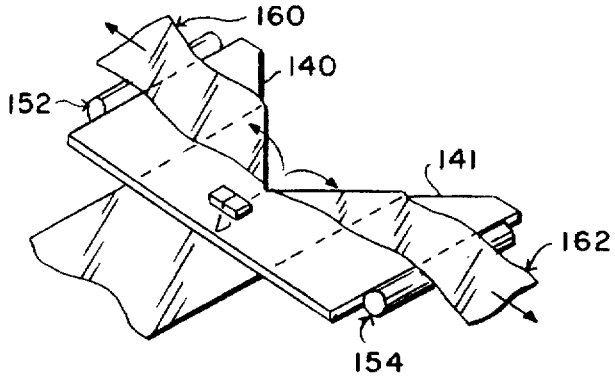
Figure 12C:
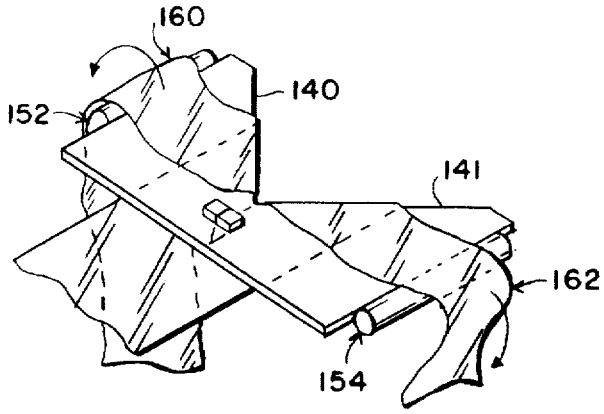
Figure 12D:
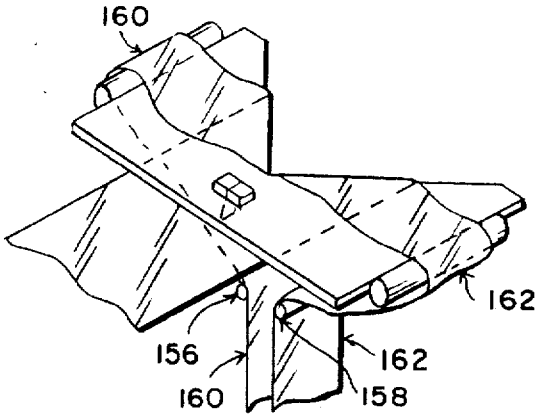

A second preferred embodiment of the packaging instrumentation 20 includes the sealing mechanism 30, tubing sections 62, 64, and holding mechanism 70. As shown in FIGS. 10 and 11, the embodiment includes only two rotatable rolls or sources **120*a*, 120*b* of flexible film sheeting 122*a*, 122*b*, extending in generally orthogonal planar portions 124*a*, 124*b*, respectively, and a sheeting divider assembly 130. Assembly 130 includes a generally horizontally disposed planar metallic plate 132 having opposed first and second longitudinal edges 133, 134 orthogonal to a transverse edge 135, a top surface 136, and a bottom surface 137. Edge segments 138, 139 are orthogonal, respectively, to the edges 133, 134, and form, respectively, an obtuse angle with edge segments 140, 141 which meet orthogonally at a point 142 on the longitudinal median of plate 132. Preferably, the plate 132 is fabricated from an aluminum alloy. Assembly 130 further includes a slitting mechanism 146 having two blocks 147, 148 mounted on surface 136 and disposed on either side of the longitudinal median between point 142 and edge 135, and a blade 150 clamped between the blocks which extends below surface 137. Assembly 130 further includes opposed first and second rollers 152, 154 disposed proximate to edges 133, 134, respectively, and opposed third and fourth rollers 156, 158 disposed below surface 137 and proximate, respectively, to a plane orthogonal to plate 132 passing through the plate longitudinal median, and to tubing sections 62, 64. As shown schematically in FIG. 12A, sheeting portion 124*a* is fed beneath plate 132 proximate to surface 137, and is slit longitudinally by blade 150 into two halves 160, 162. As shown in FIGS. 12B–12C, the halves 160, 162 move in opposite directions to overlap, respectively, edge segments 140, 141, then pass over rollers 152, 154, respectively, and then be directed downwardly. As shown in FIG. 12D, the halves 160, 162 are then directed to pass over rollers 156, 158, respectively, which are proximate, respectively, to tubing sections 62, 64 (not shown in FIG. 12D). As in the first instrumentation embodiment, the packaging instrumentation 20 then uses the halves 160, 162 to form the outer walls of two-compartment packages. Referring again to FIGS. 10 and 11, after passing over a roller 164 the film sheeting portion 124*b* is fed between edge segments 140, 141 forward of point 142 and between tubing sections 62, 64** to form a separator wall dividing package compartments.

The second instrumentation embodiment is preferred when indicia are to be printed on the outer walls of a package. Alignment of front and back indicia is assured because alignment of halves 160, 162 can be closely controlled.

What is claimed is:

1. An instrumentation for continuously manufacturing, in repetitive cycles, from film sheeting a multiplicity of peripherally sealed dispensing packages each having a first plurality of sealed juxtaposed compartments, each compartment containing a material, the instrumentation comprising:

at least three continuous supplies of flexible film sheeting, each supply extending in a generally planar sheeting portion;

means for feeding each sheeting portion so that the portions are aligned and mutually parallel, thereby determining two opposed outer portions and at least one inner portion, each pair of adjacent portions being separated by a predetermined distance;

means for simultaneously forming a first lateral seal, opposed side seals, and said first plurality of juxtaposed compartments, of each of a predetermined number of packages, the packages attached at contiguous side seals when the number of packages is more than one;

means for injecting a material between each pair of adjacent portions;

means for simultaneously forming a second lateral seal of each package, opposed to the first lateral seal; and reciprocating means for releasably holding the fully sealed package in a fixed position in the interim between repetitive cycles to thereby maintain the feeding sheet portions in alignment between the feeding means and the sealing means.

2. The instrumentation of claim 1, wherein:

the means for feeding each sheeting portion comprises a rotatable roll of sheeting and a second plurality of rollers;

the means for simultaneously forming the first lateral seal, side seals, and compartments of each package comprises a sealing mechanism comprising opposed first and second platens each having a contact portion, the platens moveable orthogonal to the parallel sheeting portions so that each contact portion simultaneously contacts and exerts pressure on an outer sheeting portion, each contact portion comprising a generally planar heated surface orthogonal to a third plurality of generally parallel planar surfaces, said third plurality being one more than the number of packages simultaneously formed, each consecutive pair of parallel surfaces bounding a compartment-shaped cavity;

the means for injecting materials comprises a tubing section inserted between each pair of adjacent sheeting portions; and the means for simultaneously forming the second lateral seal of each package comprises said sealing mechanism.

3. The instrumentation of claim 2, wherein each material is selected from the group consisting of a gel, a paste, and a liquid.

4. An instrumentation for continuously manufacturing, in repetitive cycles, from film sheeting a multiplicity of peripherally sealed dispensing packages each having two sealed juxtaposed compartments, each compartment containing a material, the instrumentation comprising:

first and second continuous supplies of film sheeting, each supply extending in a generally planar sheeting portion;

means for dividing longitudinally the first sheeting portion into first and second halves and directing the halves in opposite directions, and aligning the halves to be proximate and parallel;

means for feeding the second sheeting portion and the first and second halves of the first sheeting portions so that said second sheeting portion and said halves are aligned and mutually parallel, thereby determining two opposed outer portions and one inner portion, each pair of adjacent portions being separated by a predetermined distance;

means for simultaneously forming a first lateral seal, opposed side seals, and said first plurality of juxtaposed compartments, of each of a predetermined number of packages, the packages attached at contiguous side seals when the number of packages is more than one;

means for injecting a material between each pair of adjacent portions;

means for simultaneously forming a second lateral seal of each package, opposed to the first lateral seal; and reciprocating means for releasably holding the fully sealed package in a fixed position in the interim between repetitive cycles to thereby maintain the feeding sheet portions in alignment between the feeding means and the sealing means.

5. The instrumentation of claim 4, wherein said means for dividing the first sheeting portion into two halves, directing the halves in opposite directions, and aligning the halves to be proximate and parallel comprises a sheeting divider assembly, the assembly comprising:

a metallic plate having opposed top and bottom planar surfaces and opposed first and second longitudinal edges orthogonal to a transverse edge, said longitudinal edges orthogonal, respectively, to first and second edge segments, said edge segments forming, respectively, an obtuse angle with third and fourth edge segments meeting orthogonally at the longitudinal median of the plate;

a slitting mechanism having first and second blocks mounted on the plate top surface and disposed on either side of the plate longitudinal median, and a blade clamped between the blocks and extending below the plate bottom surface;

opposed first and second rollers disposed proximate and parallel to, respectively, said first and second longitudinal edges; and opposed third and fourth rollers disposed below the plate bottom surface and proximate to a plane orthogonal to the plate and passing through the plate longitudinal median.

6. A process for continuously manufacturing, in repetitive cycles, peripherally sealed packaging having a plurality of sealed juxtaposed compartments, each compartment containing a material, said process comprising the steps of:

feeding at least three coflexuous supplies of flexible film sheeting, each extending in a generally planar portion, so that the portions are aligned and mutually parallel, thereby determining two opposed outer portions and at least one inner portion, each pair of adjacent portions separated by a predetermined distance;

forming simultaneously a first lateral seal and opposed side seals peripherally determining and common to a plurality of rearwardly open juxtaposed compartments;

injecting a material between each pair of adjacent portions;

forming a second lateral seal of the package, opposed to the first lateral seal and common to the plurality of compartments; and disengagingly holding the fully sealed package in fixed position in the interim between repetitive cycles to thereby maintain the feeding sheet portions in alignment between the feeding step and the sealing step.

7. The process of claim 6, wherein each material is selected from the group consisting of a gel, a paste, and a liquid.

* * * * *